US011179861B2

(12) United States Patent
Khubani et al.

(10) Patent No.: US 11,179,861 B2
(45) Date of Patent: Nov. 23, 2021

(54) HAIR TRIMMING APPARATUS

(71) Applicant: Church & Dwight Co., Inc., Ewing, NJ (US)

(72) Inventors: Anand Khubani, Morristown, NJ (US); Eric Langberg, Milford, PA (US); Aaron Szymanski, Thomaston, CT (US)

(73) Assignee: Church & Dwight Co., Inc., Ewing, NJ (US)

( * ) Notice: Subject to any disclaimer, the term of this patent is extended or adjusted under 35 U.S.C. 154(b) by 51 days.

(21) Appl. No.: 15/932,888

(22) Filed: May 15, 2018

(65) Prior Publication Data

US 2018/0326602 A1 Nov. 15, 2018

Related U.S. Application Data

(60) Provisional application No. 62/506,312, filed on May 15, 2017.

(51) Int. Cl.

| | |
|---|---|
| ***B26B 19/38*** | (2006.01) |
| ***B26B 19/06*** | (2006.01) |
| ***B26B 19/46*** | (2006.01) |
| ***F21V 23/04*** | (2006.01) |

(52) U.S. Cl.

CPC ..... *B26B 19/063* (2013.01); *B26B 19/3846* (2013.01); *B26B 19/3873* (2013.01); *B26B 19/3886* (2013.01); *B26B 19/46* (2013.01); *F21V 23/04* (2013.01)

(58) Field of Classification Search

CPC ..... B26B 19/063; B26B 19/3846; B26B 19/3873; B26B 19/3886; B26B 19/46; F21V 23/04

See application file for complete search history.

(56) References Cited

U.S. PATENT DOCUMENTS

| | | | |
|---|---|---|---|
| 1,506,139 | A | 8/1924 | Severson |
| 1,997,096 | A | 4/1935 | Andis |
| 2,067,075 | A | 1/1937 | Clark |
| 2,102,529 | A | 12/1937 | Hanley |
| 2,151,965 | A | 3/1939 | Hanley |
| 2,242,405 | A | 5/1941 | Sussman |
| 2,246,586 | A | 6/1941 | Hanley |
| 2,290,326 | A | 7/1942 | Hanley |
| 2,323,655 | A | 7/1943 | Hanley |
| D175,141 | S | 7/1955 | Andis |

(Continued)

FOREIGN PATENT DOCUMENTS

| | | | |
|---|---|---|---|
| CN | 304777729 | S | 8/2018 |
| DE | 202013103187 | U1 | 9/2013 |

(Continued)

OTHER PUBLICATIONS

Replacement Shaver Comb for Solo Micro, www.amazon.com, 1 page, reviewed as early as Oct. 2019 (Year: 2019).

(Continued)

*Primary Examiner* — Arman B Fallahkhair

(74) *Attorney, Agent, or Firm* — Womble Bond Dickinson (US) LLP

(57) ABSTRACT

The present invention provides for a hair trimming apparatus having a pivotally attached blade cartridge with a blade that is insert-molded to a jacket and has a rear surface that is etched.

12 Claims, 4 Drawing Sheets

(56) References Cited

U.S. PATENT DOCUMENTS

| | | | | |
|---|---|---|---|---|
| 3,279,056 | A | 10/1966 | Andis | |
| 3,290,774 | A | 12/1966 | Schuessler | |
| D219,699 | S | 1/1971 | Poisson | |
| 3,654,699 | A | 4/1972 | Garcia | |
| 3,675,324 | A | 7/1972 | Yamada et al. | |
| D230,219 | S | 1/1974 | Glaberson | |
| 4,085,503 | A | 4/1978 | Beck et al. | |
| 4,348,810 | A | 9/1982 | Oda et al. | |
| D276,562 | S | 11/1984 | Mizobata et al. | |
| D286,454 | S | 10/1986 | Stephens | |
| 4,813,133 | A | 3/1989 | Locke et al. | |
| D311,971 | S | 11/1990 | Faerber | |
| D361,637 | S | 8/1995 | Miskin | |
| 5,504,997 | A | 4/1996 | Lee | |
| 5,579,581 | A | 12/1996 | Melton | |
| 5,937,526 | A | 8/1999 | Wahl et al. | |
| 5,970,616 | A * | 10/1999 | Wahl | B26B 19/063 30/199 |
| D437,661 | S | 2/2001 | Pinchuk | |
| D463,623 | S | 9/2002 | Kling et al. | |
| 6,481,104 | B1 | 11/2002 | Parker et al. | |
| 6,502,312 | B2 | 1/2003 | Beutel et al. | |
| 6,665,938 | B2 | 12/2003 | McCambridge et al. | |
| 6,684,511 | B2 | 2/2004 | McCambridge et al. | |
| 6,739,053 | B2 | 5/2004 | McCambridge et al. | |
| 6,807,736 | B2 | 10/2004 | Langley | |
| D506,034 | S | 6/2005 | Cornelissen | |
| 6,986,206 | B2 | 1/2006 | McCambridge et al. | |
| D519,678 | S | 4/2006 | Butcher | |
| D530,858 | S | 10/2006 | Kling | |
| 7,188,422 | B2 * | 3/2007 | McCambridge | B26B 19/06 30/122 |
| D559,456 | S | 1/2008 | Melton et al. | |
| D565,793 | S | 4/2008 | Wallace | |
| D593,254 | S | 5/2009 | Tamsiran | |
| 7,536,787 | B2 | 5/2009 | Blaustein et al. | |
| 7,536,789 | B2 | 5/2009 | Michel | |
| D600,408 | S | 9/2009 | Micinilio et al. | |
| D604,908 | S | 11/2009 | Kling | |
| D617,497 | S | 6/2010 | Goodhead | |
| D619,301 | S | 7/2010 | Wattam et al. | |
| D619,304 | S | 7/2010 | Shen | |
| D620,196 | S | 7/2010 | Nicoll et al. | |
| D629,159 | S | 12/2010 | Yoon | |
| D646,438 | S | 10/2011 | Leventhal et al. | |
| D649,712 | S | 11/2011 | Pan et al. | |
| 8,061,041 | B2 * | 11/2011 | Jessemey | B26B 21/225 30/45 |
| 8,065,802 | B2 * | 11/2011 | Oglesby | B26B 21/46 30/32 |
| D664,298 | S | 7/2012 | Grabes et al. | |
| D675,378 | S | 1/2013 | Boulanger | |
| 8,439,190 | B2 | 5/2013 | Michel | |
| 8,528,216 | B2 | 9/2013 | Melton et al. | |
| D696,460 | S | 12/2013 | Prat-Pfister et al. | |
| D696,461 | S | 12/2013 | Prat-Pfister et al. | |
| 8,850,707 | B2 * | 10/2014 | Maichel | B26B 19/06 30/200 |
| D753,879 | S | 4/2016 | Andersson | |
| D754,399 | S | 4/2016 | Andersson | |
| D754,400 | S | 4/2016 | Andersson | |
| D756,565 | S | 5/2016 | Andersson | |
| D758,016 | S | 5/2016 | Andersson | |
| D758,661 | S | 6/2016 | Andersson | |
| D758,662 | S | 6/2016 | De Klein | |
| 9,381,655 | B2 | 7/2016 | Lau | |
| 9,393,707 | B2 | 7/2016 | Wevers et al. | |
| 9,434,078 | B2 | 9/2016 | Julemont | |
| D776,878 | S | 1/2017 | Andersson et al. | |
| D790,769 | S | 6/2017 | Drori | |
| D791,410 | S | 7/2017 | Whittaker et al. | |
| D805,691 | S | 12/2017 | De Klein | |
| D813,459 | S | 3/2018 | Sinnott et al. | |
| D824,106 | S | 7/2018 | Teteak | |
| D824,107 | S | 7/2018 | Teteak | |
| D827,933 | S | 9/2018 | Teteak | |
| D828,627 | S | 9/2018 | Szymanski et al. | |
| D836,247 | S | 12/2018 | Van Maanen et al. | |
| D849,325 | S | 5/2019 | Szymanski et al. | |
| 10,377,049 | B2 | 8/2019 | Whittaker et al. | |
| D873,490 | S | 1/2020 | Khubani et al. | |
| D881,471 | S | 4/2020 | Zhang | |
| D884,973 | S | 5/2020 | Khubani et al. | |
| 2007/0214653 | A1 | 9/2007 | Worgull et al. | |
| 2010/0299930 | A1 | 12/2010 | Voorhorst et al. | |
| 2011/0016723 | A1 | 1/2011 | Maichel et al. | |
| 2011/0061243 | A1 | 3/2011 | Smit | |
| 2011/0214290 | A1 | 9/2011 | Micinilio et al. | |
| 2011/0225826 | A1 | 9/2011 | Leventhal | |
| 2013/0091709 | A1 | 4/2013 | Shimizu et al. | |
| 2014/0317932 | A1 | 10/2014 | Van Straaten et al. | |
| 2016/0059428 | A1 | 3/2016 | Lau | |
| 2016/0236363 | A1 | 8/2016 | Stapelbroek et al. | |
| 2017/0361476 | A1 | 12/2017 | Phoon et al. | |
| 2018/0021965 | A1 | 1/2018 | Phoon et al. | |
| 2018/0085948 | A1 | 3/2018 | Krauss et al. | |
| 2018/0326602 | A1 | 11/2018 | Khubani et al. | |
| 2020/0061856 | A1 | 2/2020 | Musallam et al. | |
| 2020/0094425 | A1 | 3/2020 | Iaccarino et al. | |

FOREIGN PATENT DOCUMENTS

| | | |
|---|---|---|
| EP | 2 450 161 | 5/2012 |
| EP | 3 450 119 | 3/2019 |
| JP | H09-253353 | 9/1997 |
| WO | WO 2009/081301 | 7/2009 |
| WO | WO 2013/072840 | 5/2013 |
| WO | WO 2013/150412 | 10/2013 |
| WO | WO 2013/160798 | 10/2013 |
| WO | WO 2015/049203 | 4/2015 |
| WO | WO 2015/074853 | 5/2015 |
| WO | WO 2015/074882 | 5/2015 |
| WO | WO 2015/075159 | 5/2015 |
| WO | WO 2015/075160 | 5/2015 |
| WO | WO 2015/158571 | 10/2015 |
| WO | WO 2015/158572 | 10/2015 |
| WO | WO 2015/158923 | 10/2015 |
| WO | WO 2016/041796 | 3/2016 |
| WO | WO 2016/042158 | 3/2016 |

OTHER PUBLICATIONS

Finishing Touch Flawless Body Commercial, www.youtube.com, posted Apr. 16, 2019, 1 page, htttps://www.youtube.com/watch?v=J0RLCnK5Eo.

* cited by examiner

HAIR TRIMMING APPARATUS

RELATED APPLICATION

This application is based on and claims priority from the provisional application entitled "HAIR TRIMMING APPARATUS" with U.S. Ser. No. 62/506,312 filed on May 15, 2017.

BACKGROUND OF THE INVENTION

Field of the Invention

This invention relates to a hair trimming apparatus and more specifically, to an apparatus having a pivotally attached blade cartridge with a blade that is insert-molded to a jacket and has a rear surface that is etched.

SUMMARY OF THE INVENTION

In one embodiment, the present invention relates to a hair trimming apparatus comprising: a housing having opposing ends, a first bottom end forming a handle and a second top end comprising an agitator; a head attached to the top end of the housing; and a blade cartridge pivotally attached to the head, and the blade cartridge comprises at least one blade and an agitator receiver, and the agitator is connected to the agitator receiver and in a use position, the agitator moves the blade allowing for trimming of a user's hair.

In another embodiment, the head covers at least a portion of the agitator. In yet another embodiment, the blade cartridge further comprises at least two blades and at least one jacket. In still another embodiment, the first blade has a rear surface that is etched. In still yet another embodiment, the first blade is insert-molded with the jacket.

In a further embodiment, the jacket comprises at least one post and the second blade comprises at least one hole for receiving the post. In another further embodiment, the blade cartridge further comprises at least one spring, at least one plate and at least one spring fixer which are received by the post, and the plate maintains space between the first and second blades. In another embodiment, the blade cartridge further comprises at least one spring, at least one plate and at least one spring fixer which are received by the post, and the plate evenly distributes pressure from the spring on the first and second blades.

In yet another further embodiment, the apparatus further comprises at least one button for activating trimming action and wherein the housing has an exterior surface, and the button is situated on the exterior surface of the housing.

In still another further embodiment, the apparatus further comprises at least one light. In yet another embodiment, the light is situated on an exterior surface of the housing. In still yet another further embodiment, the button also activates the light.

In another embodiment, the apparatus further comprises at least one motor attached to at least one transmission. In still another embodiment, the agitator is attached to the transmission. In yet another embodiment, the agitator receiver is centrally located on a rear side of the blade cartridge.

In still another embodiment, there is an axis of rotation formed by the blade cartridge and the top end of the housing. In yet another embodiment, the axis of rotation is located about the center of the rear surface of the blade cartridge.

In a further embodiment, the present invention relates to a hair trimming apparatus comprising: a housing having opposing ends, a first bottom end forming a handle and a second top end; and a blade cartridge pivotally attached to said top end of said housing, said blade cartridge comprises at least two blades and at least one jacket, a first blade is insert molded into the jacket, and the jacket comprises at least one post and a second blade comprises at least one hole for receiving the post, and the blade cartridge further comprises at least one spring, at least one plate and at least one spring fixer which are received by the post, and the plate maintains space between the first and scone blades.

In a further embodiment, the apparatus further comprises at least one agitator for moving the blades. In yet a further embodiment, at least one blade has an etched surface. In still a further embodiment, the apparatus further comprises at least one motor attached to a transmission. In still yet a further embodiment, the agitator is attached to the transmission.

In another embodiment, the apparatus further comprises at least one light. In a further embodiment, the apparatus further comprises at least one button for activating the agitator and the light. In yet a further embodiment, a portion of the agitator protrudes from the top end of the housing. In still a further embodiment, the blade cartridge further comprises at least one agitator receiver for receiving the agitator.

In a further embodiment, there is an axis of rotation formed by the blade cartridge and the top end of the housing and the axis of rotation is located about the center of the rear surface of the blade cartridge.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
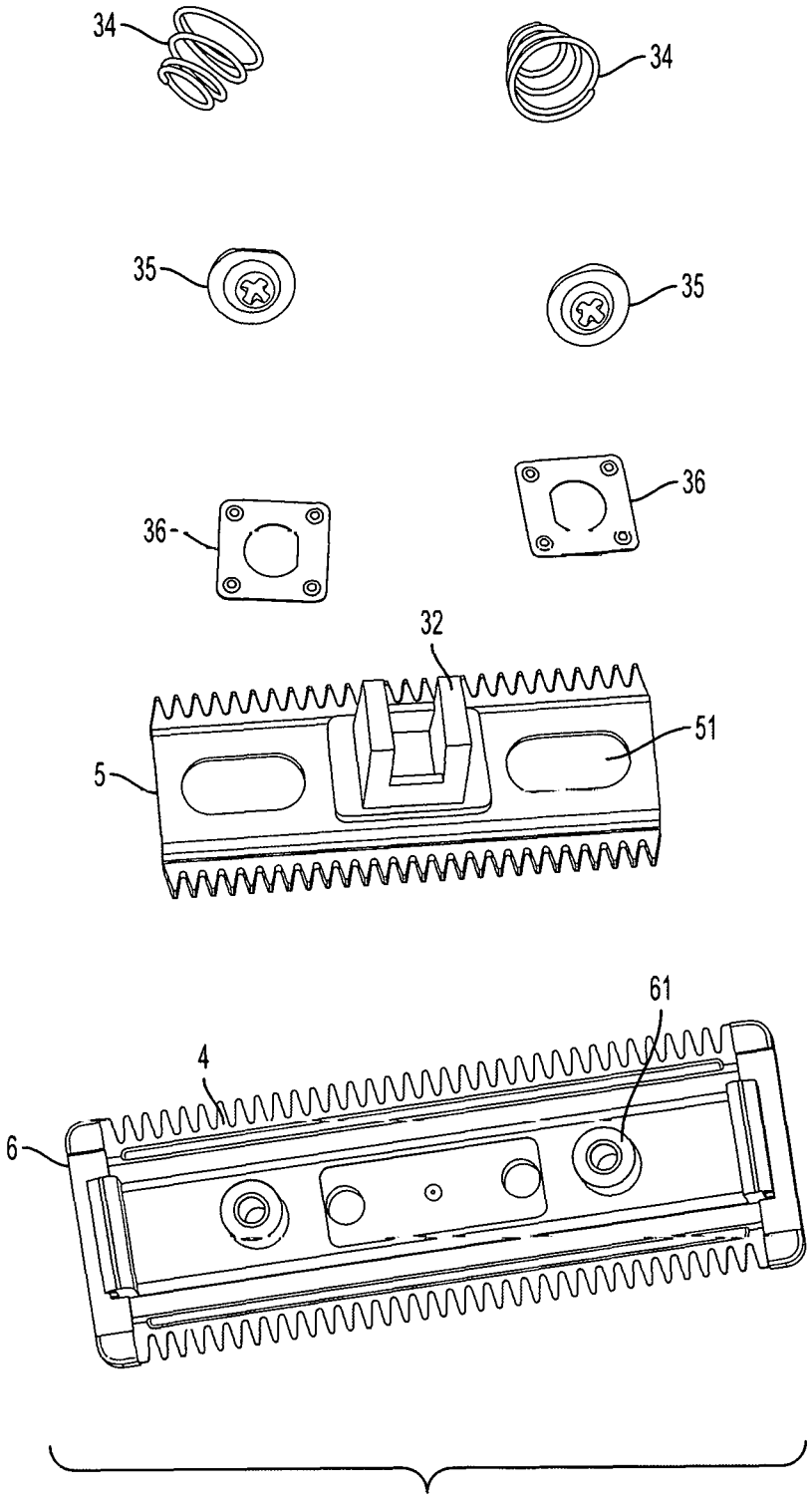
FIG. 1 is an explode view of the blade cartridge.

FIG. 1 illustrates an exploded view of the blade cartridge 3. The figure illustrates springs 34, spring fixers 35, and plates 36 which are received on posts 61 of jacket 6 of first blade 4. The Figure further illustrates second blade 5 with holes 51 which posts 61 run through. The figure further illustrates agitator receiver 32 of second blade 5. The blade cartridge 3 is made for a movable stacked arrangement. The second blade 5 is designed to be placed on top of the first blade 4. The holes 51 on the second blade 5 are designed to be received by the posts 61 of first blade 4. The holes 51 have a length that is greater than the diameter of the posts 61, this allows the second blade 5 to reciprocate to create a cutting action. The second blade 5 is secured in position adjacent the first blade 4 by blade fixers 35 that use springs 34 and plates 36 to create the optimal tension between the blades for the most effective cutting action. The agitator receiver 32 receives the agitator 14 to create the actual motion for the cutting action.

Figure 2:
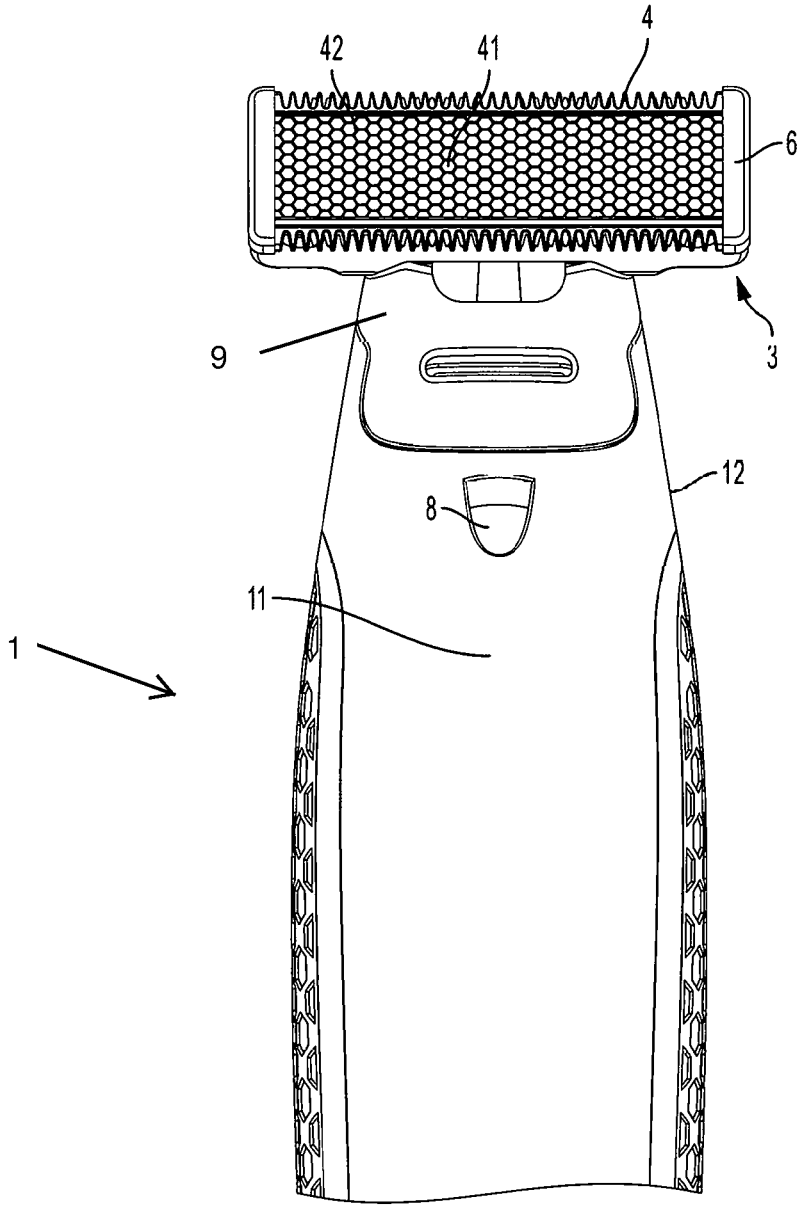
FIG. 2 is a perspective view of hair trimming apparatus with a head attached.

FIG. 2 illustrates the hair trimming apparatus having a housing 1 having opposing ends, a first bottom end forming a handle 12 and a second top end comprising an agitator 14. A head 9 is attached to the second top end of the housing 1. The head 9 covers at least a portion of the agitator 14 when attached to the second top end of the housing 1. A blade cartridge 3 is pivotally attached to the head 9 at the second top end of the housing 1. The figure further depicts the blade cartridge 3, showing the first blade 4 with a rear surface 41 having an etching (or etched surface) 42 and the jacket 6. The figure further illustrates the housing 1 having an exterior surface 11 and a light 8. The light 8 provides illumination for the area that the hair trimming apparatus is being used. The etching 42 on the rear surface 41 provides for smooth movement over a user's skin.

Figure 3:
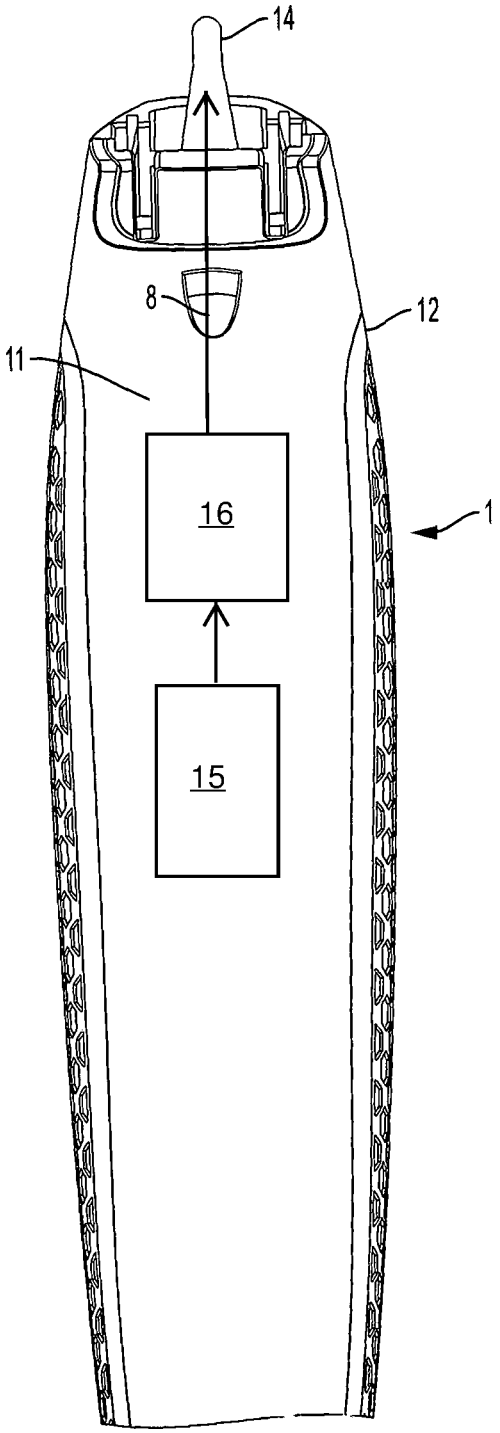
FIG. 3 is a perspective view of the hair trimming apparatus without a head attached.

FIG. 3 illustrates the hair trimming apparatus with housing 1 without a head or blade cartridge 3 attached. The figure shows the agitator 14, light 8, and exterior surface 11 of the housing at the first end 12. The housing 1 has a mostly hollow internal cavity (not shown). The internal cavity of the housing contains a power source (not shown) that is connected to a motor 15 and a transmission 16 that is connected to and drives the agitator 14. The motor 15 is also connected to circuitry and wire that link it to the button 7, the button 7 allows a user to tum the device on and off. The internal housing further contains a power source (not shown) that can be a disposable or rechargeable battery. The power source provides the energy to operate the motor 15, the motor 15 and power source are connected to one another.

Figure 4:
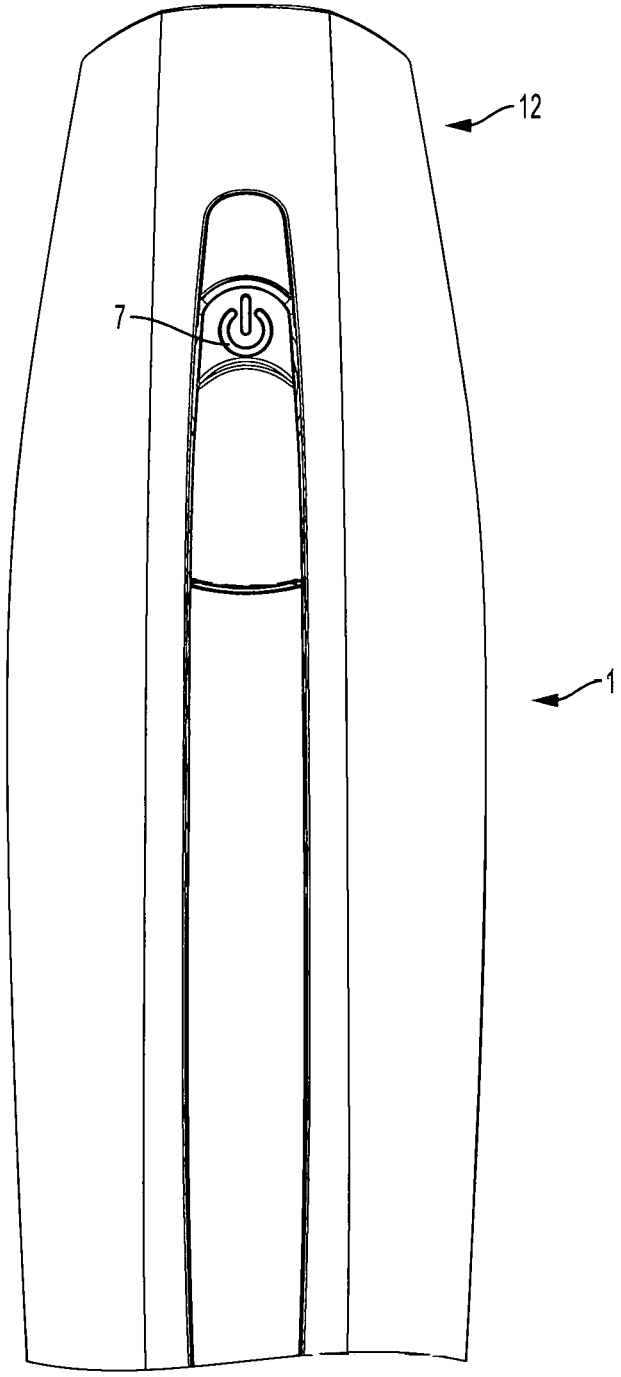
FIG. 4 is a perspective view of the hair trimming apparatus without a head.

FIG. 4 illustrates the hair trimming apparatus with housing 1 without a head attached. The figure shows a button 7 that is at the first end (handle) 12 of the housing 1. The button 7 is linked to internal circuitry and wire that allow the user to power the hair trimming apparatus on and off.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A hair trimming apparatus comprising: a housing defining a longitudinal axis and having opposing ends, a first bottom end and a second top end, wherein an internal cavity is defined between the first bottom end and the second top end of the housing for containing a motor and transmission connected to one another; an agitator extending out of the second top end of the housing and in connection with the transmission; at least one light arranged on the housing to illuminate an area of trimming; and a blade cartridge comprising: at least one jacket, a first blade having a first surface and an opposing second surface, the first blade being insert molded into the at least one jacket such that the first surface of the first blade is exposed relative to the jacket for movement of the first surface of the first blade over a user's skin; a second blade arranged about the opposing second surface of the first blade and being movable relative to the first blade, and an agitator receiver arranged on the second blade and arranged to receive the agitator, wherein in response to the motor receiving power, the transmission drives the agitator to move said second blade and allow for trimming of the user's hair; the jacket comprises a post, and the blade cartridge comprises at least one spring received by the post and at least one plate that evenly distributes pressure from the spring on the first and second blades.

2. The apparatus of claim 1 wherein said jacket comprises at least one post and said second blade comprises at least one hole for receiving said post, said at least one hole having a length that is greater than a diameter of said at least one post to allow said second blade to reciprocate.

3. The apparatus of claim 2 said blade cartridge further comprises the at least one spring, the at least one plate and at least one spring fixer which are received by said post, said plate maintains space between said first and second blades.

4. The apparatus of claim 2 said blade cartridge further comprises the at least one spring, the at least one plate and at least one spring fixer which are received by said post, said plate evenly distributes pressure from said spring on said first and second blades.

5. The apparatus of claim 1 wherein there is an axis of rotation formed by said blade cartridge and said second top end of said housing.

6. The apparatus of claim 5 wherein said axis of rotation is located about a center of a rear surface of said blade cartridge.

7. The apparatus of claim 1 wherein said first surface of the first blade is etched.

8. The apparatus of claim 1 further comprises at least one button for activating trimming action and wherein said housing has an exterior surface, said button is situated on said exterior surface of said housing.

9. The apparatus of claim 1 wherein said light is situated on an exterior surface of said housing.

10. The apparatus of claim 1 wherein said button also activates said light.

11. The apparatus of claim 1 wherein said agitator receiver is centrally located toward a rear side of said second blade, an opposing front side of the second blade being adjacent to the opposing second surface of the first blade.

12. The apparatus of claim 1, wherein the at least one light is arranged to illuminate an area of the user's hair during trimming.

* * * * *